US005228296A

United States Patent [19]

Howard

[11] Patent Number: 5,228,296

[45] Date of Patent: Jul. 20, 1993

[54] CRYOGENIC RECTIFICATION SYSTEM WITH ARGON HEAT PUMP

[75] Inventor: Henry E. Howard, Grand Island, N.Y.

[73] Assignee: Praxair Technology, Inc., Danbury, Conn.

[21] Appl. No.: 842,494

[22] Filed: Feb. 27, 1992

[51] Int. Cl.[5] ..... F25J 1/02; F25J 3/02

[52] U.S. Cl. ..... 62/22; 62/40; 62/27; 62/28; 62/31; 62/34; 62/44; 62/24

[58] Field of Search ..... 62/22, 27, 28, 31, 34, 62/44, 24, 40

[56] References Cited

U.S. PATENT DOCUMENTS

| | | | |
|---|---|---|---|
| 2,784,572 | 3/1957 | Wucherer et al. | 62/175.5 |
| 3,108,867 | 10/1963 | Dennis | 62/22 |
| 3,173,778 | 3/1965 | Gaumer, Jr. | 62/22 |
| 3,181,306 | 5/1965 | Geist et al. | 62/22 |
| 3,222,878 | 12/1965 | Becker | 62/13 |
| 3,596,471 | 8/1971 | Steich | 62/22 |
| 4,057,407 | 11/1977 | Bigi | 62/22 |
| 4,345,925 | 8/1982 | Cheung | 62/13 |
| 4,384,876 | 5/1983 | Mori et al. | 62/22 |
| 4,433,990 | 2/1984 | Olszewski | 62/22 |
| 4,533,375 | 8/1985 | Erickson | 62/22 |
| 4,747,860 | 5/1988 | Atkinson | 62/22 |
| 4,935,044 | 6/1990 | Schoenpflug | 62/22 |
| 4,968,337 | 11/1990 | Layland et al. | 62/24 |
| 5,034,043 | 7/1991 | Rottmann | 62/22 |
| 5,078,766 | 1/1992 | Guilleminot | 62/22 |
| 5,100,447 | 3/1992 | Krishnamurthy et al. | 62/22 |
| 5,100,635 | 3/1992 | Krishnamurthy et al. | 62/22 X |

*Primary Examiner*—Henry A. Bennet
*Assistant Examiner*—Christopher B. Kilner
*Attorney, Agent, or Firm*—Stanley Ktorides

[57] ABSTRACT

A cryogenic rectification system wherein condensed heat pump fluid is subcooled in the upper portion of an argon column, cools incoming feed, and is compressed and then condensed against cryogenic rectification plant bottoms for reboil thus improving reflux ratios and increasing argon recovery.

12 Claims, 4 Drawing Sheets

CRYOGENIC RECTIFICATION SYSTEM WITH ARGON HEAT PUMP

TECHNICAL FIELD

This invention relates generally to cryogenic rectification of fluid mixtures comprising oxygen, nitrogen and argon, e.g. air, and, more particularly, to cryogenic rectification for the production of argon.

BACKGROUND ART

Argon is becoming increasingly more important for use in many industrial applications such as in the production of stainless steel, in the electronics industry, and in reactive metal production such as titanium processing.

Argon is generally produced by the cryogenic rectification of air. Air contains about 78 percent nitrogen, 21 percent oxygen and less than 1 percent argon. Because the argon concentration in air is relatively low, it has the highest per unit value of the major atmospheric gases. However, conventional cryogenic air separation processes can recover only about 70 percent of the argon in the feed air. Thus it is desirable to increase the recovery of argon produced by the cryogenic rectification of air.

Accordingly it is an object of this invention to provide a cryogenic rectification system which can produce argon with increased recovery.

SUMMARY OF THE INVENTION

The above and other objects which will become apparent to one skilled in the art upon a reading of this disclosure are attained by the present invention one aspect of which is:

A method for separating air by cryogenic rectification comprising:

(A) providing cooled feed air into a cryogenic rectification plant comprising at least one column and separating the feed air in the cryogenic rectification plant by cryogenic rectification to produce nitrogen-enriched fluid and oxygen-enriched fluid;

(B) passing argon-containing fluid from the cryogenic rectification plant into an argon column and separating the argon-containing fluid in the argon column by cryogenic rectification to produce crude argon and oxygen-richer fluid;

(C) withdrawing heat pump vapor from the upper portion of the argon column, warming the withdrawn heat pump vapor, compressing the warmed heat pump vapor and cooling the compressed heat pump vapor; and (D) condensing the cooled, compressed heat pump vapor by indirect heat exchange with oxygen-enriched fluid and passing resulting condensed heat pump fluid into the argon column.

Another aspect of the invention is:

Cryogenic air separation apparatus comprising:

(A) a main heat exchanger, a cryogenic rectification plant comprising at least one column, an argon column, means for providing fluid from the main heat exchanger into the cryogenic rectification plant and means for providing fluid from the cryogenic rectification plant into the argon column;

(B) a heat pump compressor, means for providing fluid from the upper portion of the argon column to the main heat exchanger and from the main heat exchanger to the heat pump compressor;

(C) means for providing fluid from the heat pump compressor to the main heat exchanger and from the main heat exchanger to the lower part of the cryogenic rectification plant; and (D) means for providing fluid from the lower part of the cryogenic rectification plant to the upper portion of the argon column.

As used herein the terms "upper portion" and "lower portion" mean those sections of a column respectively above and below the midpoint of a column.

As used herein the term "feed air" means a mixture comprising primarily nitrogen, oxygen and argon such as air.

As used herein the term "turboexpansion" means the flow of high pressure gas through a turbine to reduce the pressure and the temperature of the gas thereby generating refrigeration.

As used herein the term, "column", means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column and/or on packing elements which may be structured packing and/or random packing elements. For a further discussion of distillation columns, see the Chemical Engineers' Handbook, fifth edition, edited by R. R. Perry and C. H. Chilton, McGraw-Hill Book Company, New York, Section 13, *The Continuous Distillation Process.* The term, double column is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 123 degrees Kelvin.

As used herein the term "indirect heat exchange" means the bringing of two fluid streams into heat exchange relation without any physical contact or intermixing of the fluids with each other.

As used herein the term "argon column" means a column which processes a feed comprising argon and produces a product having an argon concentration which exceeds that of the feed and which may include a heat exchanger or a top condenser in its upper portion.

As used herein the term "equilibrium stage" means a contact process between vapor and liquid such that the exiting vapor and liquid streams are in equilibrium.

As used herein the term "cryogenic rectification plant" means a plant wherein separation by vapor/liquid contact is carried out at least in part at a temperature at or below 123 degrees Kelvin while other auxiliary process components or equipment may be above this temperature.

As used herein, the term "oxygen-enriched fluid" comprises oxygen-containing fluid produced in a single column cryogenic rectification plant or in the higher pressure column of a double column cryogenic rectification plant and excludes oxygen-containing fluid produced in the lower pressure column of a double column cryogenic rectification plant.

DETAILED DESCRIPTION

The invention comprises in general the incorporation of a defined argon heat pump circuit between the lower part of a cryogenic air separation plant and the upper portion of an argon column thereby shifting a major heat transfer to a high temperature while simultaneously providing for more reflux to the lower pressure separation thus increasing the argon recovery. The invention will be described in detail with reference to the Drawings.

Figure 1:
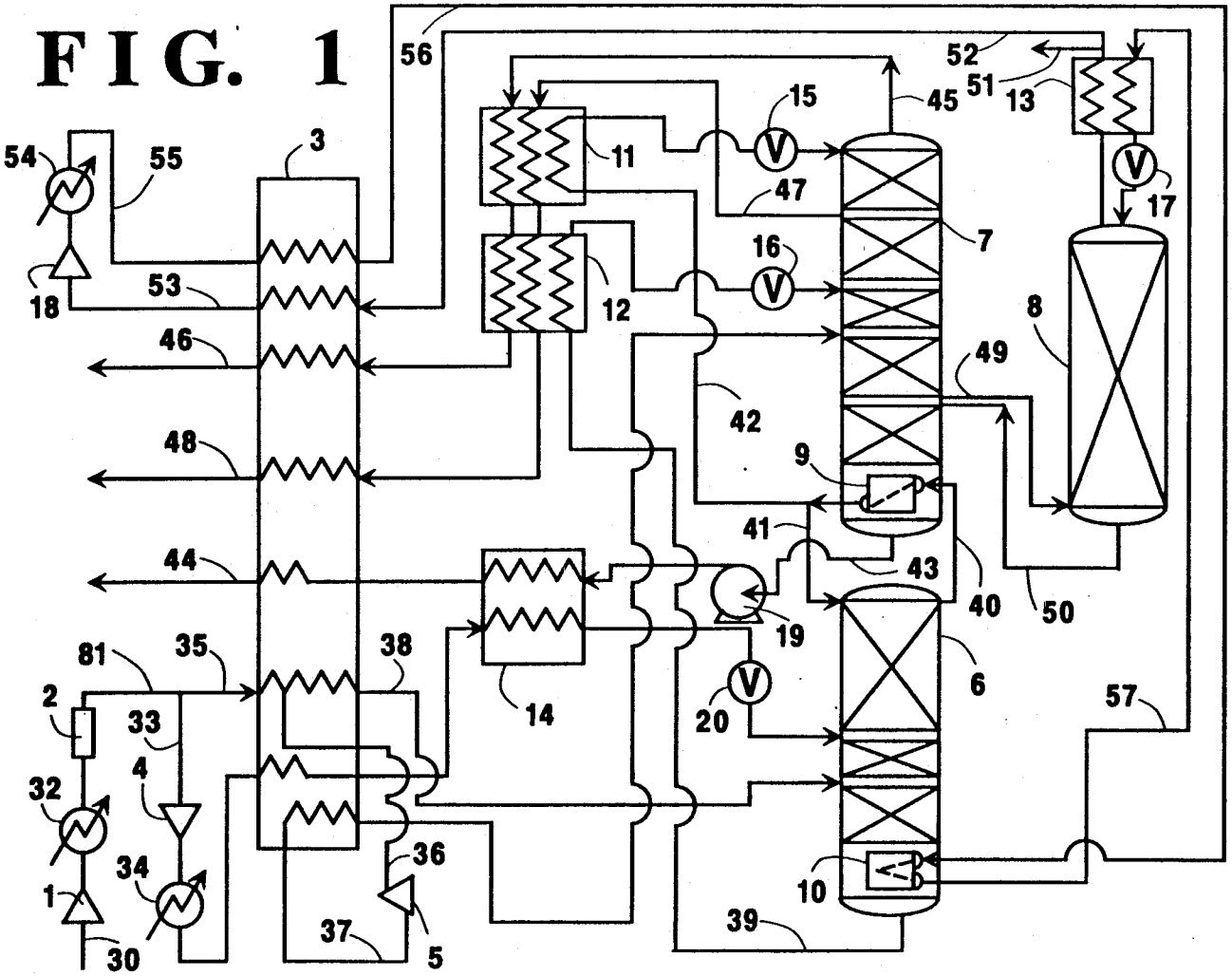
FIG. 1 is a schematic flow diagram of one preferred embodiment of the invention wherein the cryogenic rectification plant comprises a double column.

Referring now to FIG. 1, feed air 30 is compressed by passage through compressor 1, cooled by passage through cooler 32 and cleaned and dried by passage through adsorber 2. The cleaned, compressed air 81 is cooled by passage through main heat exchanger 3 by indirect heat exchange with return streams as will be described in greater detail below. In the embodiment illustrated in FIG. 1, a portion 33, comprising from 25 to 45 percent of cleaned, compressed feed air 81, is further compressed by passage through compressor 4, cooled by passage through cooler 34, further cooled by passage through main heat exchanger 3, subcooled through heat exchanger 14, and passed through valve 20 into column 6 which is the higher pressure column of a double column cryogenic rectification plant and is operating at a pressure within the range of from 65 to 220 pounds per square inch absolute (psia). Another portion 35 of the cleaned, compressed feed air 81 is passed directly into main heat exchanger 3. A portion 36 of stream 35 partially traverses main heat exchanger 3 and is cooled to a temperature where it can be expanded through turboexpander 5 in order to generate refrigeration. Resulting stream 37 is passed through main heat exchanger 3 and then into lower pressure column 7 which is the lower pressure column of the double column cryogenic rectification plant and is operating at a pressure lower than that of column 6 and within the range of from 15 to 75 psia. The main portion 38 of the feed air is passed from main heat exchanger 3 into column 6.

Within column 6 feed air is separated by cryogenic rectification into nitrogen-enriched vapor and oxygen-enriched liquid. Oxygen-enriched liquid is withdrawn from column 6 as stream 39, subcooled by passage through heat exchanger 12 and passed through valve 16 into column 7. Nitrogen-enriched vapor is withdrawn from column 6 as stream 40, condensed in main condenser 9 by indirect heat exchange with boiling column 7 bottoms, a portion 41 returned to column 6 as reflux and another portion 42 subcooled by passage through heat exchanger 11 and passed through valve 15 into column 7. If desired, a portion of oxygen-enriched liquid in stream 39 may be used to cool the upper portion of the argon column and the resulting oxygen-enriched vapor and remaining liquid passed into column 7.

Within column 7 the various feeds are separated by cryogenic rectification into oxygen-rich and nitrogen-rich fluids. Oxygen-rich liquid is withdrawn from column 7 as stream 43, pumped to a higher pressure through pump 19, warmed by passage through heat exchangers 14 and 3 and may be recovered as product oxygen in stream 44. Nitrogen-rich vapor is withdrawn from column 7 as stream 45, warmed by passage through heat exchangers 11, 12 and 3 and may be recovered as product nitrogen in stream 46. A nitrogen-containing waste stream 47 is removed for product purity control purposes from below the top of column 7, and is passed through heat exchangers 11, 12 and 3 prior to being removed from the system as stream 48.

A fluid containing from about 5 to 30 percent argon is passed as stream 49 from the lower pressure column of the cryogenic rectification plant into argon column system 8 which includes heat exchanger 13. Within the argon column, fluid 49 is separated by cryogenic rectification into crude argon and an oxygen-richer fluid. Oxygen-richer fluid is passed as stream 50 into column 7. Crude argon having an argon concentration of at least 80 percent argon is warmed by passage through heat exchanger 13 and may be recovered as crude argon product in stream 51.

Heat pump vapor is withdrawn from the upper portion of the argon column. In the embodiment illustrated in FIG. 1 the heat pump vapor comprises crude argon withdrawn from heat exchanger 13, The withdrawn heat pump vapor in stream 52 is then warmed by passage through main heat exchanger 3 thereby serving to provide cooling for the feed air and thus pass refrigeration into the cryogenic rectification plant. The warmed heat pump vapor is then compressed by passage through heat pump compressor 18. Heat pump compressor 18 will compress the warmed heat pump vapor generally by a factor of about three. The heat of compression is removed from the heat pump vapor by cooler 54 and the compressed heat pump vapor 55 is cooled by passage through main heat exchanger 3.

The cooled, compressed heat pump vapor 56 is then condensed by indirect heat exchange with oxygen-enriched fluid. In the embodiment illustrated in FIG. 1, the cooled, compressed heat pump vapor 56 is condensed by passage through heat pump condenser 10 which is located in the lower portion of column 6 in the lower part of the cryogenic rectification plant. Resulting condensed heat pump fluid 57 is then passed into the upper portion of the argon column. In the embodiment illustrated in FIG. 1, fluid 57 is passed through heat exchanger 13 wherein it is subcooled by indirect heat exchange with warming crude argon which is employed in part as the heat pump vapor. Between heat exchanger 13 and the column proper the fluid passes through valve 17.

Figure 2:
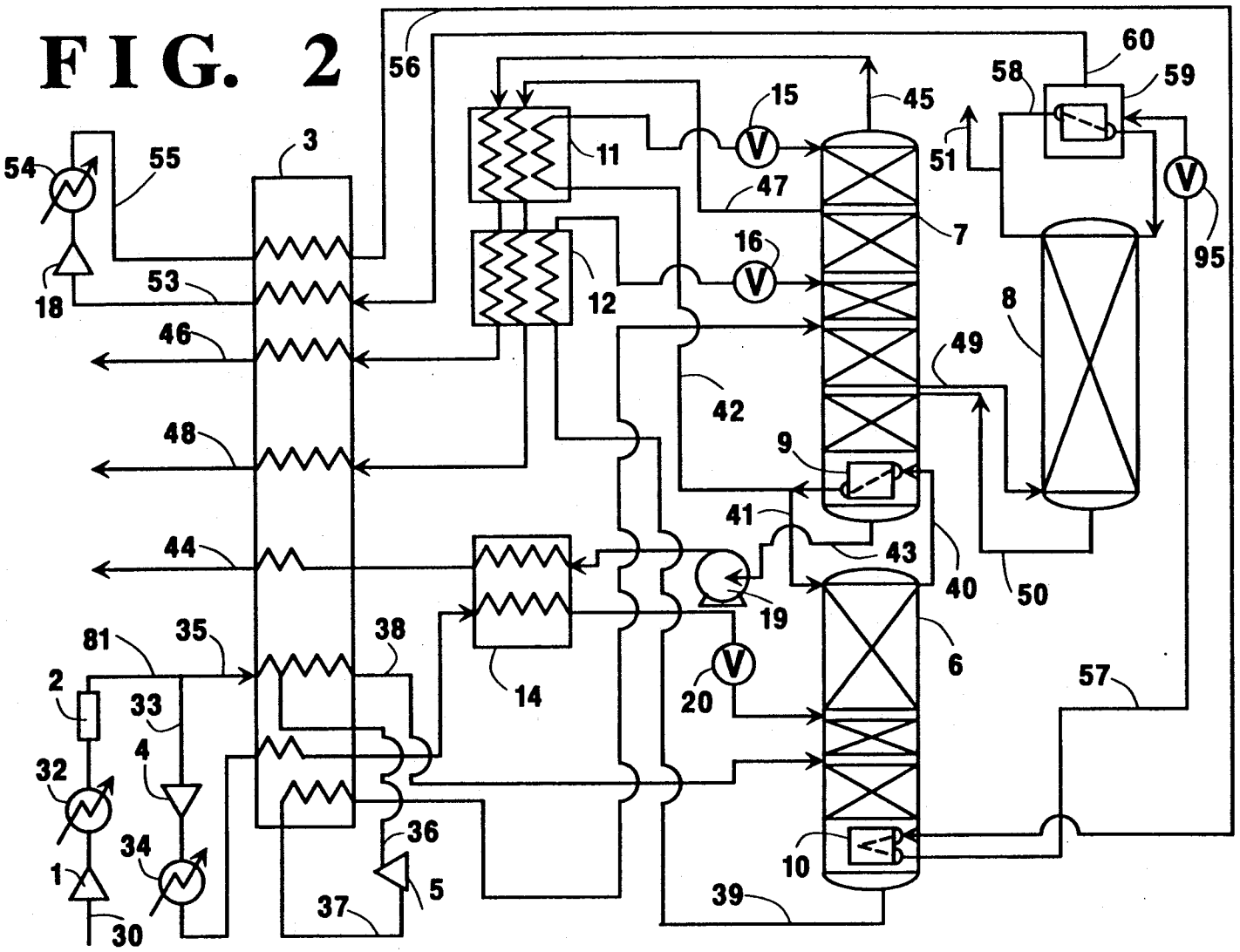
FIG. 2 is a schematic flow diagram of another embodiment of the invention wherein the argon column includes a top condenser.

FIG. 2 illustrates another embodiment of the invention wherein the argon column comprises a top condenser rather than a heat exchanger. With the embodiment illustrated in FIG. 2 the heat pump circuit may be closed and the heat pump fluid need not contain argon. Among the heat pump fluids which may be employed in the practice of the invention in accord with the embodiment illustrated in FIG. 2, in addition to argon-containing fluids such as crude argon, one can name air, oxygen and nitrogen. The numerals in the embodiment illustrated in FIG. 2 correspond to those of FIG. 1 for the common elements and these common elements will not be described again in detail. Referring now to FIG. 2, a portion 58 of the crude argon is condensed in top condenser 59 by indirect heat exchange with heat pump fluid and is employed as reflux for the argon column. Heat pump vapor 60 is withdrawn from top condenser 60 of argon column 8, warmed by passage through main heat exchanger 3, compressed by passage through heat pump compressor 18, cooled by passage through main heat exchanger 3 and condensed by indirect heat exchange with oxygen-enriched fluid by passage through heat pump condenser 10, generally in the same manner as was described in greater detail with reference to FIG. 1. Resulting condensed heat pump fluid 57 is then passed via valve 95 into top condenser 59 in the upper portion of argon column 8 wherein it serves to condense crude argon vapor 58 and thus provide reflux for the argon column. If desired, some of the nitrogen-containing fluid from the upper part of the cryogenic rectification plant may be passed into the heat pump circuit and some of the condensed heat pump fluid may be passed into the cryogenic rectification plant, for example as reflux for either or both of the lower pressure and higher pressure columns.

In another embodiment of the invention, the oxygen-enriched fluid is not passed directly from the higher pressure column to the lower pressure column but rather is first passed in heat exchange relation with the heat pump fluid in the upper portion of the argon column prior to being passed into the lower pressure column from the higher pressure column. In this embodiment, the heat pump fluid is withdrawn from the argon column by being taken from the inner part rather than the outer part of the top condenser.

Figure 3:
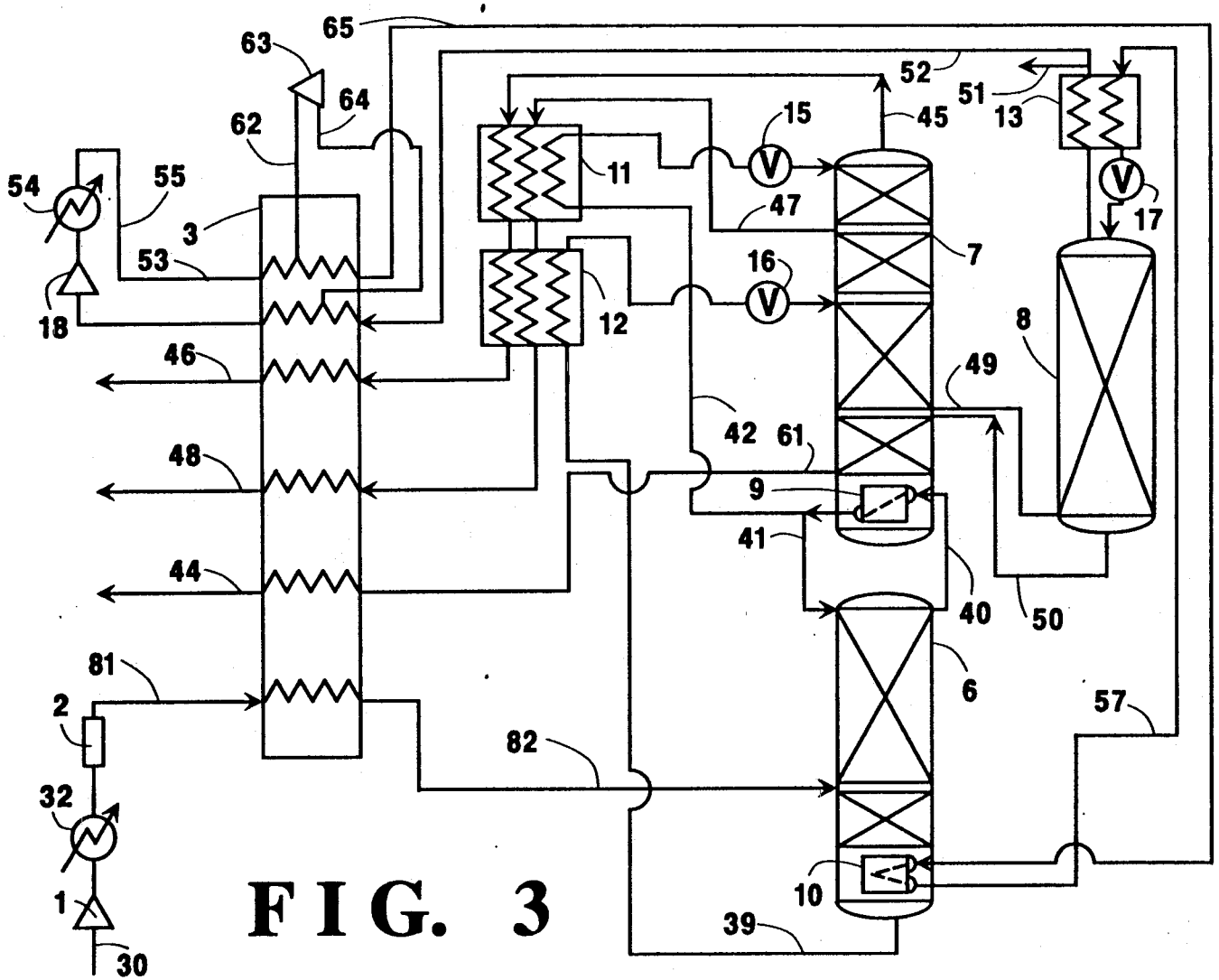
FIG. 3 is a schematic flow diagram of a preferred embodiment of the invention wherein the argon heat pump circuit includes a turboexpander.

FIG. 3 illustrates another embodiment of the invention wherein air separation is carried out at elevated column pressures and includes the production of refrigeration by the turboexpansion of a portion of the heat pump vapor and the recovery of high pressure gaseous oxygen from the upper column of the double column system without need for pumping. The numerals in the embodiment illustrated in FIG. 3 correspond to those of FIG. 1 for the common elements and these common elements will not be described again in detail. Referring now to FIG. 3 the entire cleaned, compressed feed air stream 81 is passed through main heat exchanger 3 wherein it is cooled and thereafter it is passed as stream 82 into column 6 of the cryogenic rectification plant. Oxygen-rich vapor 61 is withdrawn from column 7 from a point above main condenser 9, is warmed by passage through main heat exchanger 3 and may be recovered as product oxygen in stream 44. A pump need not be employed on the product oxygen line. In the embodiment illustrated in FIG. 3, column 6 is operating within the range of from 65 to 220 psia and column 7 is operating within the range of from 15 to 75 psia. A portion 62 of compressed heat pump vapor 55 is passed out from main heat exchanger 3 after only partial traverse thereof, and is turboexpanded through turboexpander 63 to generate refrigeration. Turboexpanded stream 64 is then passed back into main heat exchanger 3 wherein it rejoins the heat pump vapor stream 52 and, in passing through main heat exchanger 3, serves to cool the feed air and pass refrigeration into the cryogenic rectification plant to assist in carrying out the cryogenic refrigeration. The remainder of the compressed heat pump vapor 65 fully traverses main heat exchanger 3 and is then passed to heat pump condenser 10 and argon column 8 as was previously described with reference to FIG. 1.

Figure 4:
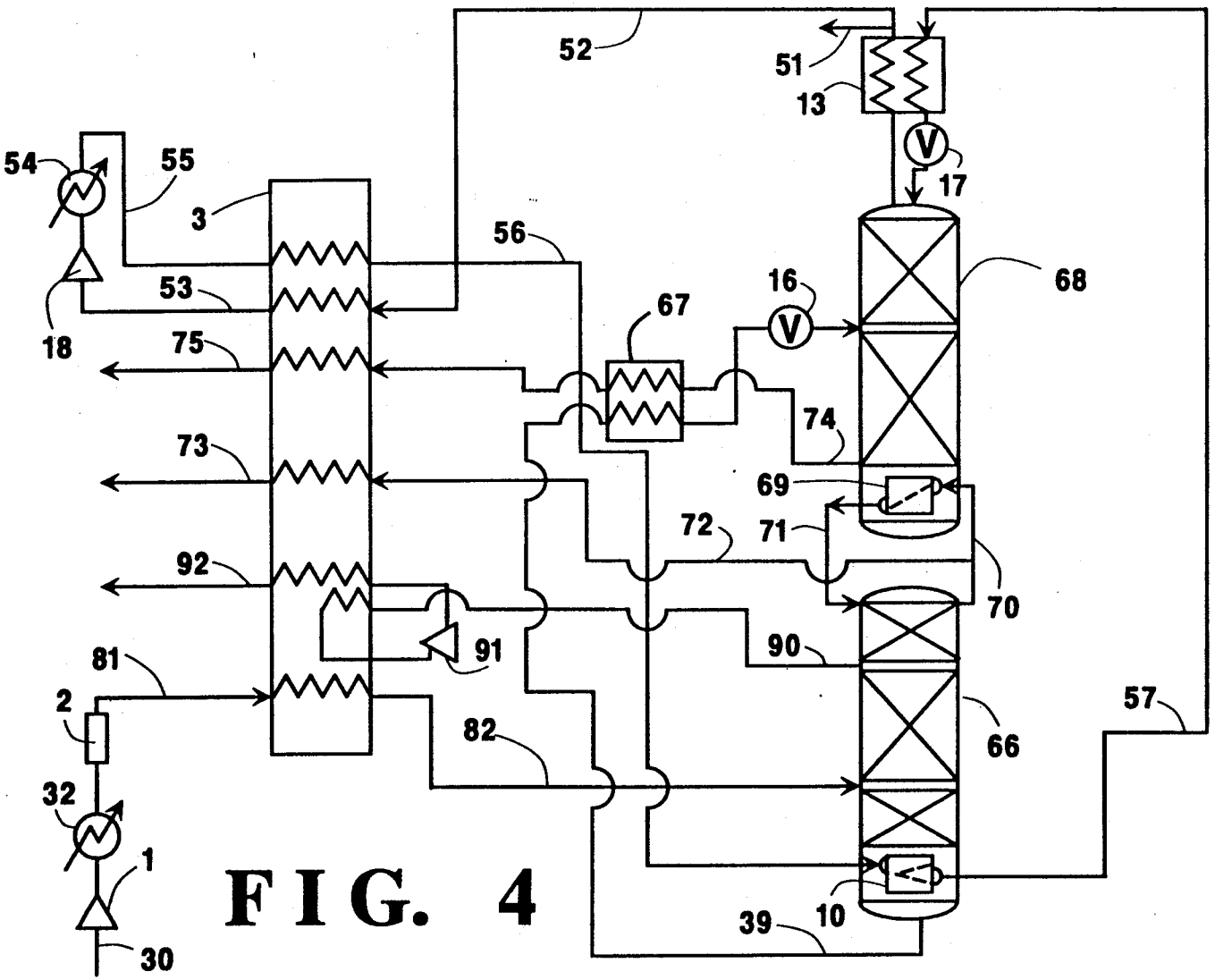
FIG. 4 is a schematic flow diagram of another embodiment of the invention wherein the cryogenic rectification plant comprises a single column.

FIG. 4 illustrates yet another embodiment of the invention wherein the cryogenic rectification plant comprises a single column. The numerals in the embodiment illustrated in FIG. 4 correspond to those of FIG. 1 for the common elements and these common elements will not be described again in detail. Referring now to FIG. 4, cleaned, compressed feed air 81 is cooled by passage through main heat exchanger 3 and then passed as stream 82 into the cryogenic rectification plant which comprises single column 66 operating at a pressure within the range of from 65 to 220 psia wherein the feed air is separated by cryogenic rectification into oxygen-enriched fluid and nitrogen-enriched fluid. Oxygen-enriched liquid is withdrawn in stream 39 from column 66, subcooled by passage through heat exchanger 67 and passed through valve 16 into argon column 68 which is in heat exchange relation with column 66 through condenser 69 and is operating at a pressure within the range of from 15 to 75 psia. Nitrogen-enriched vapor is removed from column 66 as stream 70 condensed by indirect heat exchange with column 68 bottoms in condenser 69 and returned as stream 71 into column 66 as reflux. A portion 72 of nitrogen-enriched vapor 70 may be passed through main heat exchanger 3 and recovered as product nitrogen in stream 73. Nitrogen-containing waste stream 90 is taken from the upper portion of column 66, warmed by partial traverse of heat exchanger 3, turboexponded through turboexpander 91 to generate refrigeration and then passed through heat exchanger 3 to cool incoming feed air thus providing refrigeration for the cryogenic rectification. Resulting waste stream 92 is then removed from the system. Within argon column 68 the fluid in stream 39 is separated by cryogenic rectification into crude argon and oxygen-richer fluid. Oxygen-richer fluid is withdrawn from column 68 as stream 74, warmed by passage through heat exchangers 67 and 3 and may be recovered as oxygen product in stream 75. Crude argon is recovered from argon column heat exchanger 13 as stream 51 and also employed as the heat pump vapor in stream 52 in a manner similar to that described with respect to the embodiment illustrated in FIG. 1.

The following example presents the results of a simulation of the invention carried out with the embodiment illustrated in FIG. 1 wherein all of the columns employed structured packing as vapor-liquid contact elements in all of the column sections. The only liquid requirement involves the flow of liquid nitrogen necessary in order to sustain the argon refinery. The pressure at the top of the lower pressure column is maintained at a pressure sufficient to remove nitrogen from the cryogenic rectification plant. About 13.5 percent of the air flow is retrieved as a nitrogen waste for use in adsorbent bed regeneration. The example is provided for illustrative purposes and is not intended to be limiting.

The entire feed air stream is first compressed by a pressure ratio of about 6, and is then passed through adsorbent beds for the removal of water vapor, carbon dioxide and hydrocarbons. A portion equivalent to about a third of the total air stream is further compressed to an elevated pressure, is subsequently cooled with cooling water and is introduced into the main heat exchanger where it is cooled to a temperature close to its dewpoint. Another portion of the air stream is withdrawn from a midpoint temperature and turboexpanded for process refrigeration. This air is expanded to a pressure level sufficient to overcome pressure drops incurred in the subsequent heat exchanger passes. This expanded air is returned to the primary heat exchanger where it is further cooled to a temperature close to its dewpoint. This low pressure air is fed to an intermediate point of the lower pressure column. The remaining portion of compressed air is fed directly to an intermediate point in the higher pressure column.

The portion of air compressed to the highest pressure is liquified against pumped liquid oxygen which is withdrawn from the base of the lower pressure column. The pumped liquid oxygen vaporizes at a pressure substantially above the pressure level of the lower pressure column. This liquified air is also fed to an intermediate point of the high pressure column. A flow equivalent to about 39.0 percent of the total air flow is retrieved from the high pressure column as reflux for the lower pressure column. Oxygen-enriched liquid from the base of the high pressure column is subcooled and flashed into the low pressure column at an intermediate point so as to provide additional intermediate reflux to the separation. Below the liquid oxygen feed the cooled turboexpanded air is introduced into the low pressure distillation column. At a point still lower the feed for the argon column is withdrawn. The feed flow to the argon column is approximately 12.4 percent of the total air flow. This stream is fed directly to the base of the argon column. The resulting vapor exiting the argon subcooler at the top of the argon column is a flow equal to 12.6 percent of the total air flow. This flow of heat pump fluid is warmed and compressed by a pressure ratio of about 3.3 and is reintroduced into the main heat exchanger where it is cooled to a temperature close to that of its dewpoint. It is withdrawn and condensed in latent heat exchange with the oxygen-enriched liquid as the bottoms of the high pressure column. This flow is subsequently subcooled and flashed back into the argon column as reflux.

The process conditions described above offer an example of the utility of heat pumping argon-containing vapor exiting the argon column. For the conditions given, an argon recovery of 94.74 percent is achieved. This is considerably higher than is possible with the use of conventional methods with apparatus similar to that illustrated in FIG. 1 but lacking the heat pump circuit of the invention.

Now by the use of the method and apparatus of this invention one can carry out cryogenic air separation with argon recoveries significantly in excess of that attainable with conventional systems. The improved argon recovery results from the more favorable reflux ratios present such as in the upper sections of the lower pressure column. Condensing heat pump vapor at the lower part of a cryogenic rectification plant such as at the lower portion of the higher pressure column of a cryogenic rectification plant enables a greater portion of the nitrogen contained in the feed air to be employed as reflux. The invention shifts the latent heat exchange of condensing argon to an elevated temperature while simultaneously providing for more reflux such as to the lower pressure separation.

Although the invention has been described in detail with reference to certain preferred embodiments, those skilled in the art will recognize that there are other embodiments of the invention within the spirit and the scope of the claims.

I claim:

1. A method for separating air by cryogenic rectification comprising:

(A) providing cooled feed air into a cryogenic rectification plant comprising at least one column and separating the feed air in the cryogenic rectification plant by cryogenic rectification to produce nitrogen-enriched fluid and oxygen-enriched fluid;

(B) passing argon-containing fluid from the cryogenic rectification plant into an argon column and separating the argon-containing fluid in the argon column by cryogenic rectification to produce crude argon and oxygen-richer fluid;

(C) withdrawing heat pump vapor having an argon concentration of at least 80 percent argon from the upper portion of the argon column, warming the withdrawn heat pump vapor, compressing and warmed heat pump vapor and cooling the compressed heat pump vapor; and (D) condensing the cooled, compressed heat pump vapor by indirect heat exchange with oxygen-enriched fluid produced in the lower portion of the cryogenic rectification plant and passing resulting condensed heat pump fluid into the argon column.

2. The method of claim 1 wherein the cryogenic rectification plant comprises a double column having a higher pressure column and a lower pressure column wherein nitrogen-enriched fluid and oxygen-enriched fluid are passed from the higher pressure column into the lower pressure column and are separated therein by cryogenic rectification into nitrogen-rich and oxygen-rich fluids and wherein the argon-containing fluid is passed from the lower pressure column into the argon column.

3. The method of claim 1 wherein the cryogenic rectification plant comprises a single column and argon-containing fluid is passed from the said single column into the argon column.

4. The method of claim 1 wherein the heat pump vapor is warmed by indirect heat exchange with feed air to cool the feed air.

5. The method of claim 1 wherein a portion of the compressed heat pump fluid is turboexpanded to generate refrigeration and warmed by indirect heat exchange with feed air to cool the feed air and thus provide refrigeration for the cryogenic rectification.

6. The method of claim 2 wherein the oxygen-enriched fluid is passed in heat exchange relation with heat pump fluid in the upper portion of the argon column prior to being passed into the lower pressure column from the higher pressure column.

7. Cryogenic air separation apparatus comprising:

(A) a main heat exchanger, a cryogenic rectification plant comprising at least one column, an argon column, means for providing fluid from the main heat exchanger into the cryogenic rectification plant and means for providing fluid from the cryogenic rectification plant into the argon column;

(B) a heat pump compressor, means for providing fluid having an argon concentration of at least 80 percent percent argon from the upper portion of the argon column to the main heat exchanger and from the main heat exchanger to the heat pump compressor;

(C) means for providing fluid from the heat pump compressor to the main heat exchanger and from the main heat exchanger to the lower part of the cryogenic rectification plant; and (D) means for providing fluid from the lower part of the cryogenic rectification plant to the upper portion of the argon column.

8. The apparatus of claim 7 wherein the cryogenic rectification plant comprises a double column having a higher pressure column and a lower pressure column, the means for providing fluid from the main heat exchanger into the cryogenic rectification plant communicates with the higher pressure column, the means for providing fluid from the cryogenic rectification plant into the argon column communicates with the lower pressure column and further comprising means for providing fluid from the higher pressure column to the lower pressure column.

9. The apparatus of claim 7 wherein the cryogenic rectification plant comprises a single column, the means for providing fluid from the main heat exchanger into the cryogenic rectification plant communicates with said single column, and the means for providing fluid from the cryogenic rectification plant into the argon column communicates with said single column.

10. The apparatus of claim 7 wherein the argon column comprises a top heat exchanger.

11. The apparatus of claim 7 wherein the argon column comprises a top condenser.

12. The apparatus of claim 7 further comprising a turboexpander, means for providing fluid from the heat pump compressor to the turboexpander and means for providing fluid from the turboexpander to the main heat exchanger and to the heat pump compressor.

* * * * *